US007027745B2

(12) United States Patent
Yoshida et al.

(10) Patent No.: US 7,027,745 B2
(45) Date of Patent: Apr. 11, 2006

(54) IMAGE FORMING APPARATUS WITH NOTIFICATION OF REMAINING LIFE OF IMAGE FORMING UNIT AND PROHIBITION OF IMAGE IMPROVEMENT OPERATION

(75) Inventors: Narutaka Yoshida, Toyokawa (JP); Akira Kobayashi, Kawanishi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 97 days.

(21) Appl. No.: 10/743,908

(22) Filed: Dec. 24, 2003

(65) Prior Publication Data

US 2004/0234281 A1 Nov. 25, 2004

(30) Foreign Application Priority Data

May 23, 2003 (JP) ..... 2003-145747

(51) Int. Cl.
*G03G 15/00* (2006.01)

(52) U.S. Cl. ..... 399/25; 399/24

(58) Field of Classification Search ..... 399/24, 399/25, 26, 27, 81
See application file for complete search history.

(56) References Cited

U.S. PATENT DOCUMENTS 4,961,088 A * 10/1990 Gilliland et al. ..... 399/25
RE35,751 E * 3/1998 Midgley ..... 399/25
5,740,491 A * 4/1998 Imai ..... 399/25
5,802,419 A * 9/1998 Sakurai et al. ..... 399/26
5,826,134 A * 10/1998 Hino et al. ..... 399/27
5,877,692 A * 3/1999 Watanabe et al. ..... 399/25 X
6,226,463 B1 * 5/2001 Phillips et al. ..... 399/24
6,567,622 B1 * 5/2003 Phillips ..... 399/24
6,594,451 B1 * 7/2003 Kakeshita et al. ..... 399/24

FOREIGN PATENT DOCUMENTS

| | | |
|---|---|---|
| JP | 01-133075 | 5/1989 |
| JP | 4-9871 | 1/1992 |
| JP | 09-160445 | 6/1997 |
| JP | 10-319652 | 12/1998 |
| JP | 2001-056608 | 2/2001 |
| JP | 2002-236399 | 8/2002 |
| JP | 2002-258683 | 9/2002 |

OTHER PUBLICATIONS

Notification of Reasons for Refusal dated Aug. 16, 2005, directed to counterpart foreign application.

* cited by examiner

*Primary Examiner*—Sandra L. Brase
(74) *Attorney, Agent, or Firm*—Morrison & Foerster LLP

(57) ABSTRACT

It is intended to provide an image forming apparatus that surely notifies a user of unit replacement timing and strongly urges the user to replace units without additional apparatus being applied thereto. A color printer 1 detects remaining life of each replaceable unit. When a certain replaceable unit nearly reaches its replacement timing, the color printer 1 indicates that fact in an operation panel 75. When the remaining life lowers improvement prohibiting level, in other words, when the unit reaches its replacement timing, the color printer 1 indicates a name of the unit to be replaced and necessity of replacement in the operation panel 75 and prohibits image improvement operation. That is, an image is formed without image quality improvement operation. Thereby, image quality deteriorates. Image deterioration can surely notify a user of replacement timing of the unit and urge the user to replace the unit with a new one.

15 Claims, 10 Drawing Sheets

FIG.5

| ITEMS | | PARAMETER | DETERIORATION SPEED OF IMAGE QUALITY WHEN APPARATUS STOPS |
|---|---|---|---|
| IMAGE QUALITY ADJUSTMENT | DENSITY ADJUSTMENT | SURFACE POTENTIAL ADJUSTMENT | DETERIORATES GRADUALLY |
| | | LD LIGHT QUANTITY ADJUSTMENT | |
| | | DEVELOPMENT BIAS ADJUSTMENT | |
| | SENSOR ADJUSTMENT | AIDC SENSOR LIGHT QUANTITY ADJUSTMENT | |
| | $\gamma$ CORRECTION CONTROL | LD LUMINESCENT ADJUSTMENT | |
| REGISTRATION ADJUSTMENT | WRITE ADJUSTMENT | LD LUMINESCENT TIMING CONTROL | DETERIORATES GRADUALLY |
| NOISE ELIMINATION | ERASER CONTROL | LIGHTING CONTROL | DETERIORATES INSTANTLY |
| | DEVELOPMENT NOISE ADJUSTMENT | DEVELOPMENT BIAS ADJUSTMENT | |
| ATVC | PRIMARY TRANSFER TABLE ADJUSTMENT | TABLE ADJUSTMENT FOR EACH RESISTANCE | DETERIORATES GRADUALLY |
| | SECONDARY TRANSFER TABLE ADJUSTMENT | TABLE ADJUSTMENT FOR EACH RESISTANCE | |
| REVERSE ROTATION CONTROL OF TRANSFER BELT | CONTROL TO ROTATE / NOT TOROTATE IN REVERSE DIRECTION | | DETERIORATES RAPIDLY |
| LIFE EXTENSION CONTROL FOR PRINT UNIT | FORCED CONSUMPTION | DEVELOPMENT BIAS ADJUSTMENT | DETERIORATES GRADUALLY |
| | | LD LUMINESCENT ADJUSTMENT | |

FIG.10

| UNIT NAME | LIFE DETECTING MEANS |
|---|---|
| PRINT UNIT | COUNT NUMBER OF OUTPUTS |
| | TONER EMPTY |
| | ROTATION TIME / ROTATION DISTANCE OF PHOTOSENSITIVE DRUM |
| | FILM THICKNESS OF PHOTOSENSITIVE DRUM |
| | STATE OF DENSITY / NOISE OCCURENCE |
| BELT UNIT | COUNT NUMBER OF OUTPUTS |
| | ROTATION TIME / ROTATION DISTANCE OF BELT |
| | BELT RESISTANCE CHANGE |
| | BELT REFLECTION RATE CHANGE |
| PRIMARY TRANSFER ROLLER UNIT | COUNT NUMBER OF OUTPUTS |
| | ROTATION TIME / ROTATION DISTANCE OF ROLLER |
| | ROLLER RESISTANCE CHANGE |
| SECONDARY TRANSFER ROLLER UNIT | COUNT NUMBER OF OUTPUTS |
| | ROTATION TIME / ROTATION DISTANCE OF ROLLER |
| | ROLLER RESISTANCE CHANGE |
| LASER UNIT | STATE OF DENSITY / NOISE OCCURENCE |
| | EMISSION TIME |
| FIXING UNIT | ROTATION TIME /ROTATION DISTANCE OF ROLLER |

IMAGE FORMING APPARATUS WITH NOTIFICATION OF REMAINING LIFE OF IMAGE FORMING UNIT AND PROHIBITION OF IMAGE IMPROVEMENT OPERATION

This application is based on Application No. 2003-145747 filed in Japan, contents of which are hereby incorporated by reference.

BACKGROUND OF THE INVENTION

1. Field of the Invention

The present invention relates to an image forming apparatus such as a printer, a copier, and the like. More particularly, it relates to an image forming apparatus that includes replaceable units and is not supposed to have regular maintenance by a service person.

2. Description of Related Art

There have conventionally existed image forming apparatuses such as copiers, printers, and the like, that have a plurality of replaceable units, such as a print unit including a toner container and a photosensitive drum, a belt unit including an intermediate transfer belt, a primary transfer roller unit, a secondary transfer roller unit, a laser unit including a laser emitting apparatus, a fixing unit including fixing rollers, and the like. The above such units deteriorate as being used. Therefore, number of times to use a unit is counted to judge replacement timing. In case replacement timing is coming soon, or replacement timing has come, a user is alarmed of that fact through a display. FIG. 10 gives examples of replaceable units' names and respective life detecting means.

As to a copier or the like for office use, a service person generally checks and replaces a unit with new one any time. Therefore, in case any one of units for the copier reaches time for replacement, operation of the copier is immediately stopped in general. However, as to a printer or the like that is smaller and less complicated than a copier, a regular maintenance service contract is not arranged in many cases. Therefore, it is not preferable to stop operation of it forcedly. Accordingly, in many cases, unit replacement timing is just alarmed by indicating so in an operation panel. However, some users apt to overlook the alarm indication or even if users confirm the alarm indication, some of them keep using the printer while some fine images can be obtained.

In case a unit is kept being used over its replacement timing, e.g., in case toner residue alarm is neglected and the unit is kept being used, there may arise a fear that receipt of a facsimile message becomes impossible suddenly when toner is completely used out. Even for other units, e.g., in case an intermediate transfer belt is kept being used over its replacement timing, there may arise a fear that cracks appear on the belt and toner disperses inside the apparatus. Other than that, in case a print unit including a photosensitive drum is kept being used over its replacement timing, there may arise a fear that a bearing of the photosensitive drum gets worn out and the photosensitive drum rotates tremblingly. Under such a situation, a motor receives load larger than predetermined extent and life of the motor resultantly shortens.

Therefore, there have been devised various methods for surely notifying toner-near-empty state, to recommend a user to replace the toner cartridge. For example, Japanese Laid-open Patent Publications No. 1-133075, No. 9-160445, and No. 2001-56608 show examples of that. An electric photocopier apparatus directed to No. 1-133075 degrades its image density by reducing development width of its laser beam when toner residue lowers a predetermined amount. A recording apparatus directed to No. 9-160445 gets its printing density weaker by reducing printing dot pulse width when it gets into toner-near-empty state. Furthermore, in an electric photocopier apparatus directed to No. 2001-56608, LED chips are arranged on the back of its toner container so that light of the LED penetrates the container to generate a black line on paper when amount of toner lowers.

However, the above-mentioned respective prior techniques apply unique control methods for deteriorating an image so as to notify a user of unit replacement timing. What is more, additional parts are used for such unique control methods. Such aspects make system or structure of the apparatus complicated, which is problematic.

SUMMARY OF THE INVENTION

The present invention has been made in order to solve the foregoing problem. It is an object of the present invention to provide an image forming apparatus that surely notifies a user of unit replacement timing and strongly urges the user to replace units without additional apparatus being applied thereto.

According to a first aspect of the present invention, there is provided an image forming apparatus comprising at least one replaceable image forming unit and improvement controlling unit that controls to improve image quality of an image to be formed, the image forming apparatus conducting improvement control with the improvement controlling unit and forming an image on a recording medium with the image forming unit, wherein the image forming apparatus further comprises: a remaining life detecting unit that detects remaining life left for the image forming unit; and an improvement prohibiting unit that prohibits improvement control by the improvement controlling unit when a remaining life of the image forming unit decreases to improvement prohibiting level or less.

That is, the remaining life detecting unit detects a remaining life left for a certain one of the image forming units that are replaceable, and in case the remaining life lowers to improvement prohibiting level or less, the improvement prohibiting unit prohibits improvement control. Upon reaching improvement prohibiting level, image improvement control so far being conducted is stopped. Therefore, quality of images to be formed thereafter deteriorates. That is, deterioration of image quality notifies a user that remaining life of the image forming unit has become short. Accordingly, this system makes it possible to surely notify a user of replacement timing and which unit to be replaced, and strongly urge the user to replace the unit with a new one without adding a special apparatus to the image forming apparatus.

As examples of the image forming units, there are a print unit, a belt unit, a primary transfer roller unit, a secondary transfer roller unit, a laser unit, a fixing unit, and the like. As items of the image improvement control, there are image quality adjustment (density adjustment, sensor adjustment, γ-correction control), write adjustment for registration adjustment, eraser control and development noise adjustment for noise elimination, primary transfer table adjustment and secondary transfer table adjustment for ATVC, reverse rotation control of the transfer belt, forced consumption for life extension control of the print unit, and the like.

According to a second aspect of the present invention, there is provided an image forming apparatus comprising at least one replaceable image forming unit and improvement controlling unit that controls to improve image quality of an image to be formed, the image forming apparatus conducting improvement control with the improvement controlling unit and forming an image on a recording medium with the image forming unit, wherein the image forming apparatus further comprises: an improvement prohibiting unit that prohibits improvement control by the improvement controlling unit after predetermined timing; a display section that displays a message for a user; and a replace-urging-message displaying unit that displays a message that urges a user to replace an image forming unit with a new one in the display section before the improvement prohibiting unit prohibits improvement control.

In the image forming apparatus directed to the second aspect of the present invention, the improvement prohibiting unit prohibits improvement control after predetermined timing. Prior to prohibition of improvement control, the replace-urging-message displaying unit displays a message of urging the user to replace the image forming unit with a new one. Finding a replace urging message on the displaying section, a user can recognize that replacement of a certain image forming unit is urged before quality of image to be formed actually deteriorates. Thereby, the user can prepare a new unit and replace the old one.

According to a third aspect of the present invention, there is provided an image forming apparatus comprising at least one replaceable image forming unit and improvement controlling unit that controls to improve image quality of an image to be formed, the image forming apparatus conducting improvement control with the improvement controlling unit and forming an image on a recording medium with the image forming unit, wherein, plural items for improvement control to be done by the improvement controlling unit are provided; and the image forming apparatus further comprises an improvement prohibiting unit that prohibits the improvement controlling unit from improvement control by different timing depending on items.

Thereby, as remaining life of an image forming unit becomes shorter, the number of items of improvement control to be prohibited by the improvement prohibiting unit increases. As a result, deterioration of image quality is accelerated. Thereby, this makes it possible to surely notify a user that remaining life of the image forming unit gets further shorter. That is, this strongly urges the user to replace the unit with a new one.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

BRIEF DESCRIPTION OF DRAWINGS

For a better understanding of the present invention, reference is made to the following detailed description of the invention, just in conjunction with the accompanying drawings in which:

FIG. 5 is a chart showing examples of image improvement operations;

FIG. 10 is a chart showing names of replaceable units and examples of life detecting means for respective units.

DETAILED DESCRIPTION OF PREFERRED EMBODIMENTS

First Embodiment

Figure 1:
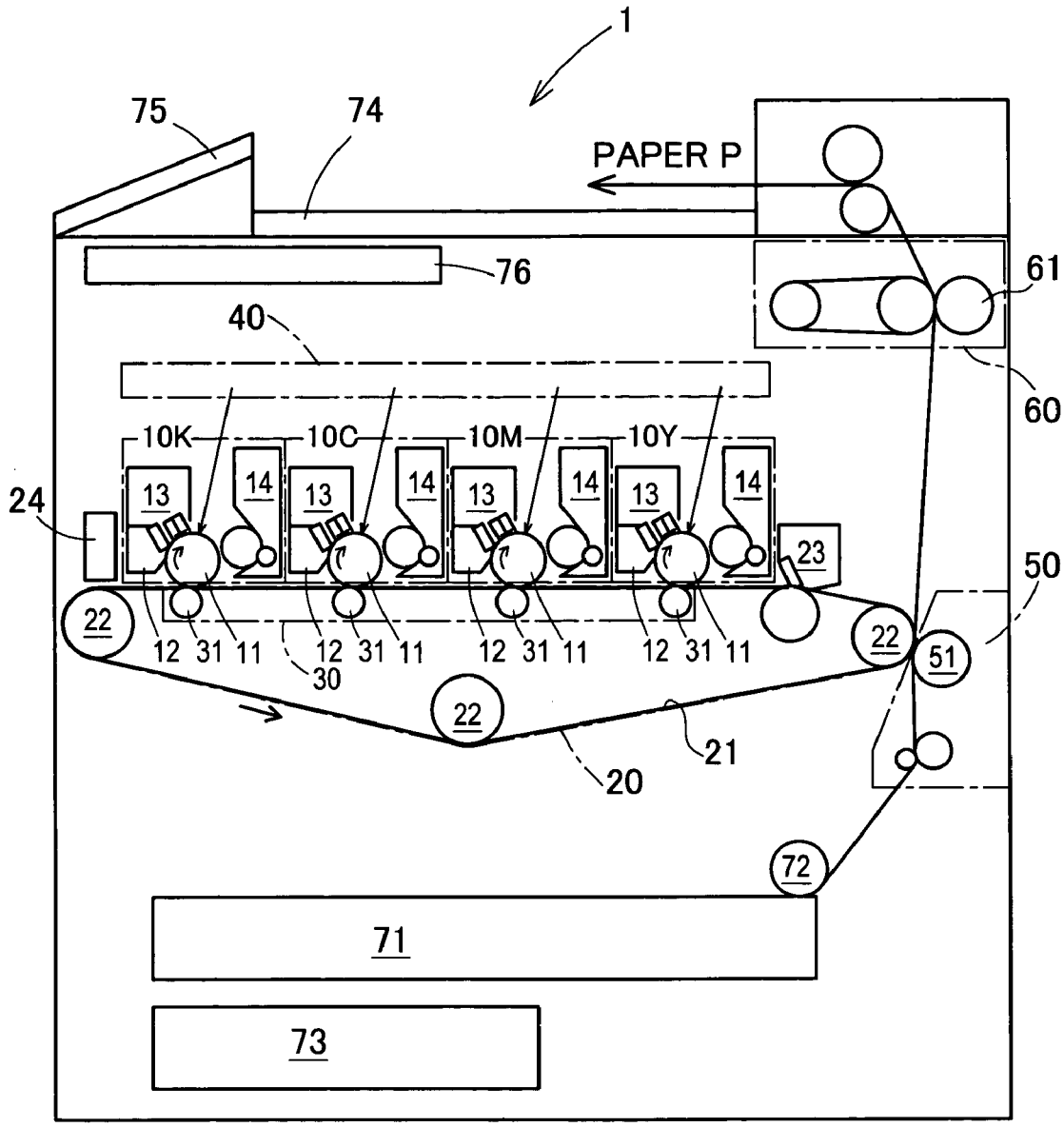
FIG. 1 is a block diagram schematically showing structure of a color printer directed to a first embodiment.

A first embodiment will be described by referring to accompanied drawings. FIG. 1 shows schematic structure of a color printer 1 to which aspects of the present invention is applied.

As shown in FIG. 1, the color printer 1 directed to the first embodiment is provided with print units 10Y, 10M, 10C, 10K for yellow, magenta, cyan, and black, respectively, which is a typical tandem type. Inner of respective print units 10Y, 10M, 10C, 10K are structured same. Therefore, same reference number is assigned to same parts of them. Each of the print units 10Y, 10M, 10C, 10K has a photosensitive drum 11 that can rotate in a direction indicated with an arrow in FIG. 1, a cleaner 12 around the photosensitive drum 11, a charger 13 and a developing device 14. A surface of the photosensitive drum 11 is coated with a thin film layer made of organic optical conductive material. Predetermined amount of toner is initially housed and sealed inside the developing device 14.

Furthermore, there are arranged a belt unit 20 including a intermediate transfer belt 21 and primary transfer roller unit 30 including four primary transfer rollers 31 below the print units 10Y, 10M, 10C, and 10K. There is arranged a laser unit 40 including a laser apparatus above the print units 10Y, 10M, 10C, and 10K. The intermediate transfer belt 21 is put tight with pulleys 22 and rotated in a direction indicated with an arrow. Furthermore, there are arranged a belt cleaner 23 and a sensor 24 in contact with the intermediate transfer belt 21.

There are further arranged a secondary transfer roller unit 50 including a secondary transfer roller 51 and a fixing roller unit 60 including a fixing roller 61 in the color printer 1. The secondary roller 51 is arranged facing to one of the pulleys 22. So-far mentioned each of the print units 10Y, 10M, 10C, 10K, the belt unit 20, the primary transfer roller unit 30, the laser unit 40, the secondary transfer roller unit 50, the fixing roller unit 60 are replaceable depending on theirs deterioration degree and each of the units corresponds to an image forming unit (see FIG. 10).

Other than the above-mentioned parts, the color printer further includes a paper feeding cassette 71, paper feeding roller 72, a power 73 at its lower part, a paper ejecting tray 74 and an operation panel 75 at its upper part. The operation panel 75 includes a display section for showing various information to a user and input sections for instruction input. There is also arranged a controller 76 for controlling the entirety of inner parts.

Next, typical image forming operation of the color printer 1 will be described. In each of the print units 10Y, 10M, 10C, and 10K, a surface of a photosensitive drum 11 is cleaned by a cleaner 12 and charged uniformly by a charger 13. Furthermore, laser beam in accordance with received color image data from a laser apparatus in a laser unit 40 is irradiated on a photosensitive drum. Thereby, potential attenuate portions appear and an electrostatic latent image is formed.

On the other hand, alternating bias that has about 1 to 10 kHz frequency, 1 to 3 kV voltage difference, 10 to 90% duty, and −100 to −800 V offset voltage, is applied to a developing device 14 so as to generate an electric field. Thereby, toner is attracted to a laser irradiated section of the photosensitive drum 11 from the developing device 14. As a result, toner image is formed on an electrostatic latent image. Next, bias polarity of which is opposite to that of toner is applied onto the intermediate transfer belt 21 by the primary transfer roller 31, and toner is transferred onto the intermediate transfer belt 21. The print units 10Y, 10M, 10C, and 10K form toner images of respective color in order and those toner images are superimposed at a same position on the intermediate transfer belt 21.

On the other hand, sheets of paper placed in the paper feeding cassette 71 are separated and fed sheet by sheet by the paper feeding roller 72 and then delivered to the secondary transfer roller 51. Furthermore, the intermediate transfer belt 21 on which a toner image is carried is rotated by the pulleys 22 and the toner image and a sheet of paper are met with each other at the position of the secondary transfer roller 51. At this stage, voltage is applied to the secondary transfer roller 51, whereby the toner image is transferred from the intermediate transfer belt 21 to the sheet of paper. Furthermore, the toner image on the sheet is fixed by the fixing roller 61 and the sheet with the fixed image is ejected to the paper ejecting tray 74. Toner remaining on the intermediate transfer belt 21 is collected by the belt cleaner 23.

The controller 76 of the color printer 1 conducts various processing for image improvement to obtain higher-quality images in addition to the above described general print operation. For example, for forming an accurate latent image on the photosensitive drum 11, the controller 76 controls charging voltage depending on condition of the photosensitive drum 11, temperature, and humidity so as to optimize its surface potential. For enhancing development quality, the controller 76 optimizes development bias and controls exposure basing on a result of detection by the sensor 24. Furthermore, for the belt cleaner 23 which is provided for eliminating toner remaining on the intermediate transfer belt 21, the intermediate transfer belt 21 is appropriately controlled to rotate in reverse direction so as to avoid leaving unwiped portion on the intermediate transfer belt 21 due to foreign matters caught between the belt and a cleaning blade of the cleaner.

Figure 2:
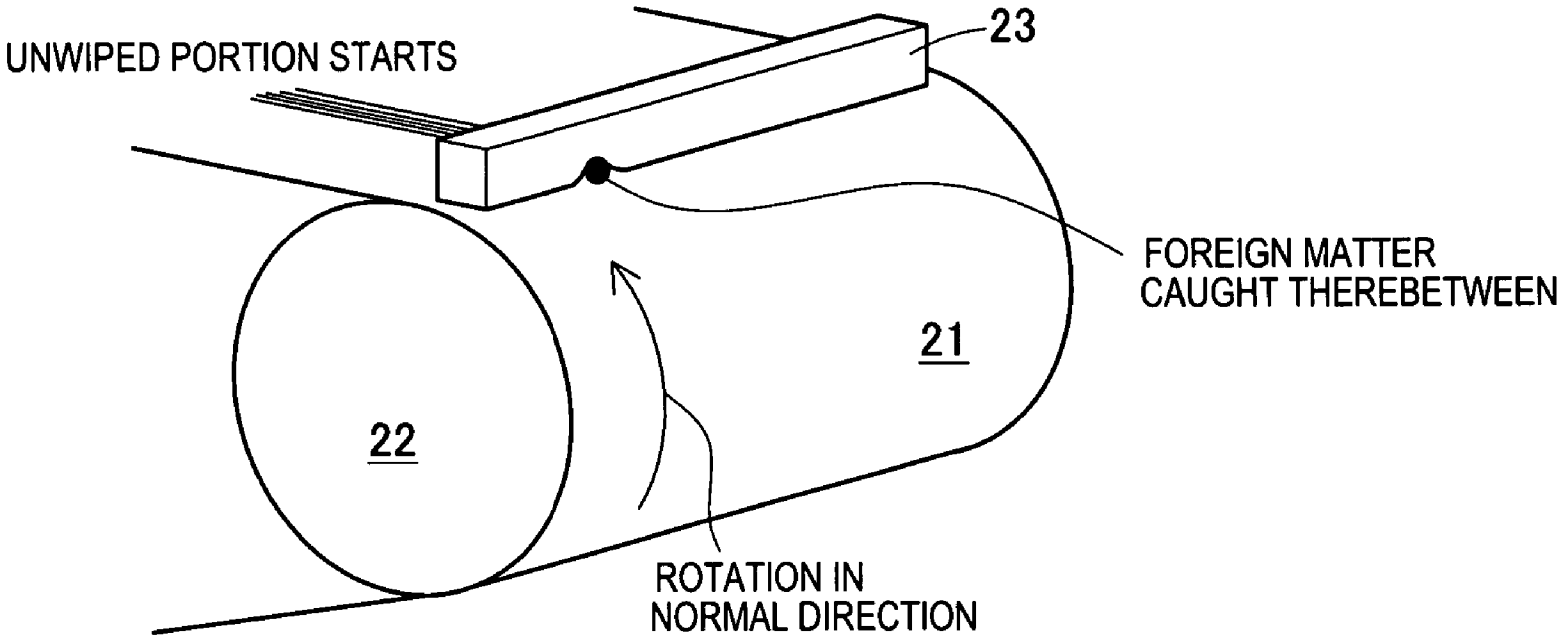
FIG. 2 is a diagram illustrating a situation that a foreign matter is caught between a cleaning blade and a roller.
Figure 3:
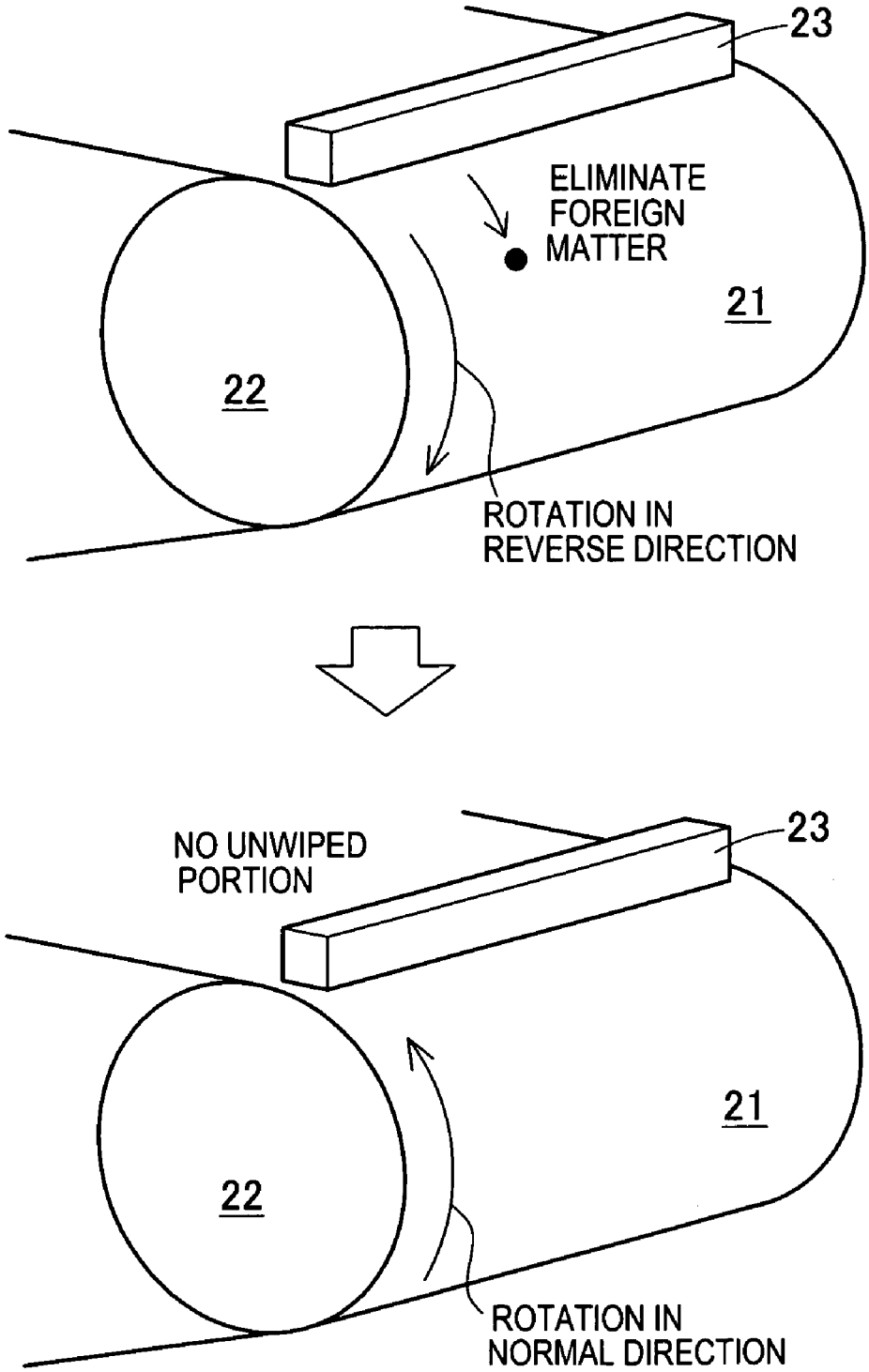
FIG. 3 is a diagram illustrating a situation that a foreign matter is eliminated by rotating intermediate transfer belt in reverse direction.

Next, there will be described reverse rotation control of the intermediate transfer belt 21 in detail. The cleaning blade of the belt cleaner 23 deteriorates as being repeatedly used and an edge of the cleaning blade wears out or chips away. As a result, foreign matters are likely to be caught in such a portion. Furthermore, in case the intermediate transfer belt 21 gets scared, foreign matter are likely to be caught. In case a foreign matter is caught between there, an unwiped portion appears straight from where the foreign matter stays, as shown in FIG. 2. For a precaution of it, as shown in FIG. 3, the intermediate transfer belt 21 is slightly rotated in reverse direction and then, rotated in normal direction again every completion of predetermined times (number of sheets) of printing. Thereby, the foreign matter caught there comes apart from the blade and eliminated by a wipe in normal direction. Otherwise, for eliminating a foreign matter, it is also practical to make the cleaning blade temporarily separate from the intermediate transfer belt 21 or to make the cleaning belt move in orthogonal direction with reference to running line of the intermediate transfer belt 21.

Figure 4:
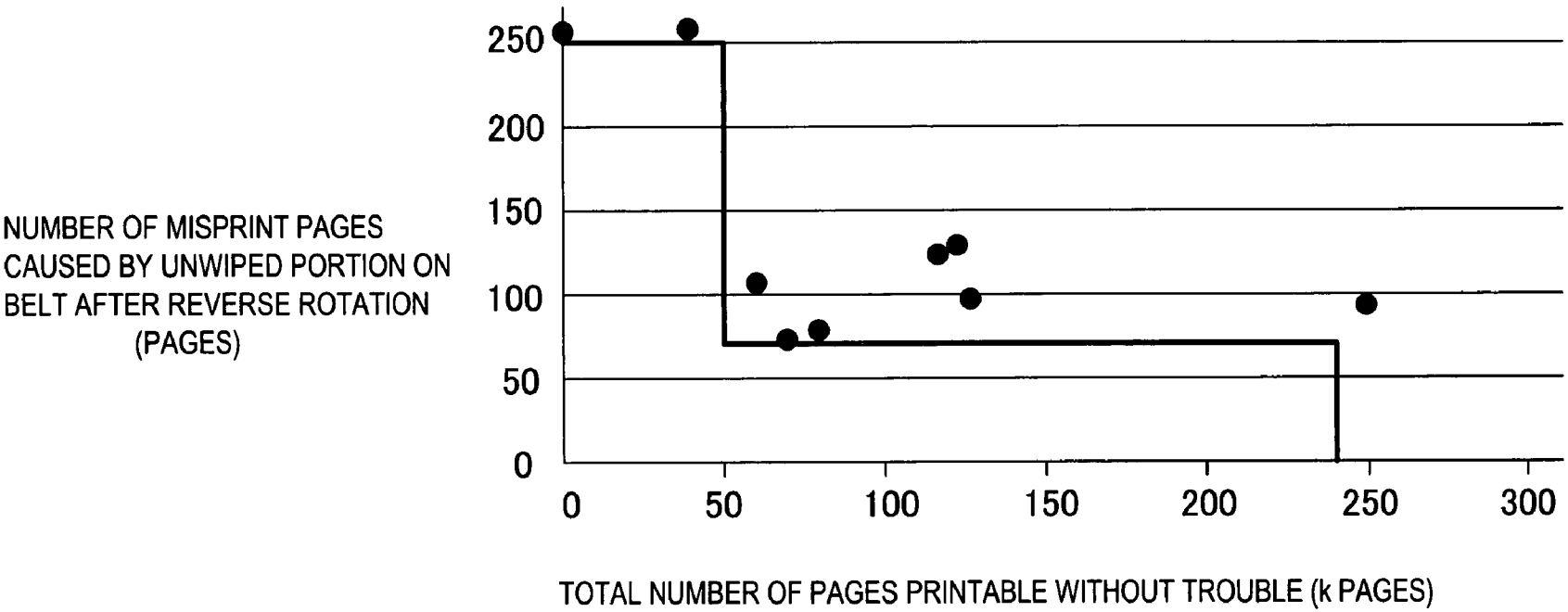
FIG. 4 is a graph showing timing that a foreign matter is caught between a cleaning blade and a roller.

The color printer 1 conducts reverse rotation control after a predetermined number of page outputs have been done. Amount of reverse rotation is of about 10 mm. To be more specific, until total number of printed pages reaches fifty thousand, the color printer 1 makes the intermediate transfer belt 21 rotate in reverse direction every two-hundred-and-fifty-page printing. After that, rotation in reverse direction is carried out once in every seventy-two-page printing. As shown in FIG. 4, a foreign matter is rarely caught while the cleaning blade and the intermediate transfer belt 21 are comparatively new. However, from a point nearly exceeding fifty thousand pages in total, frequency of foreign matter trouble rises drastically. Since the color printer 1 makes the intermediate transfer belt 21 rotate in reverse direction before foreign matter trouble rate becomes high, occurrence of unwiped portion is avoided. Thereby, high-quality images can be obtained constantly.

FIG. 5 shows examples of items for image-quality improvement control to be executed by the controller 76. As entire image-quality adjustment, density adjustment such as surface potential adjustment by the photosensitive drum 11, laser diode light quantity adjustment, developing bias adjustment and the like are conducted. Furthermore, light quantity adjustment for AIDC (Automatic Image Density Control) sensor, laser diode luminescent adjustment for γ-correction are conducted, as well. Registration adjustment for avoiding positional shift among respective colors of images, eraser control for eliminating noises on the photosensitive drum 11, and development noise adjustment are conducted. Furthermore, primary/secondary transfer table adjustment is conducted so as to correct transfer potential difference of voltage to be applied to transfer rollers and actually effective voltage. Still further, reverse rotation of the intermediate transfer belt 21 which is described above and forced consumption control for ejecting degraded toner in the print unit are regularly conducted. Those control operations serve to form even higher quality images. The controller 76 for conducting those control operations corresponds to an improvement controlling unit.

The color printer 1 has various replaceable unit structure, as described. Since those units deteriorate as being used, they need to be changed appropriately. Therefore, the controller 76 in the color printer 1 detects state of use with respect to each unit at all time and judges its remaining life. As shown in FIG. 10, there are various life detecting means for respective replaceable units, and one or two of the life detecting means is/are selected and used for each unit. For example, cumulative rotating time of the intermediate transfer belt 21 is timed to detect remaining life of the belt unit 20. That is, the controller 76 works as a remaining life detecting unit.

When thus obtained remaining life lowers a predetermined level, the color printer 1 notifies a user of that fact so as to urge the user to replace the unit with a new one. For that purpose, the color printer 1 makes the operation panel 75 indicate a notice to urge a user to replace the unit in its display section and stops one or more of the items for image quality improvement control so as to degrade image quality. The controller 76 works as a replace-urging-message displaying unit and as an improvement controlling unit when such control operations are conducted. In case any one of replacement timing with respect to each unit has come, reverse rotation of the transfer belt is stopped in this embodiment.

When any one of replacement timing with respect to each unit comes near, the color printer 1 makes the operation panel 75 indicate such a notice in its display section. For example, replace timing of the belt unit 20 comes when about two hundred and forty thousand pages in total are printed. So, when two hundred and twenty-eight thousand pages in total, i.e., 95% of the above figure, are printed, a message such as "Time to replace the present belt unit will come soon" is indicated in the operation panel 75. Thereby, a user is urged to prepare a new unit for replacement of the old one. At this stage, the color printer 1 does not make image quality deteriorate. That is, a remaining life level at which a replacement urging message is indicated, in other words, a precautionary level, is longer than a remaining life level at which improvement control is prohibited. Accordingly, a user receives the precautionary message before image quality deteriorates and can previously avoid having an image of which image quality deteriorates.

Exceeding two hundred and twenty-eight thousand pages and reaching two hundred and forty thousand pages in total, the color printer 1 makes the operation panel 75 indicate "Replace the present belt unit with a new one". This is a replacement demanding message. At the same time, reverse rotation control of the intermediate transfer belt 21 is stopped while a replacement demanding message is indicated and the old belt unit 20 is actually replaced with a new one. As a result, by the time another one hundred pages are printed exceeding the two hundred and forty pages, a foreign matter is caught at the belt cleaner 23 to generate an unwiped portion there and image quality deteriorates gradually. Accordingly, such image quality deterioration surely notifies a user of replacement timing of the unit and strongly presses the user to replace. Thereby, replacement of the belt unit 20 can highly be expected before the belt unit 20 chips away due to continuous use over its expected life.

Figure 6:
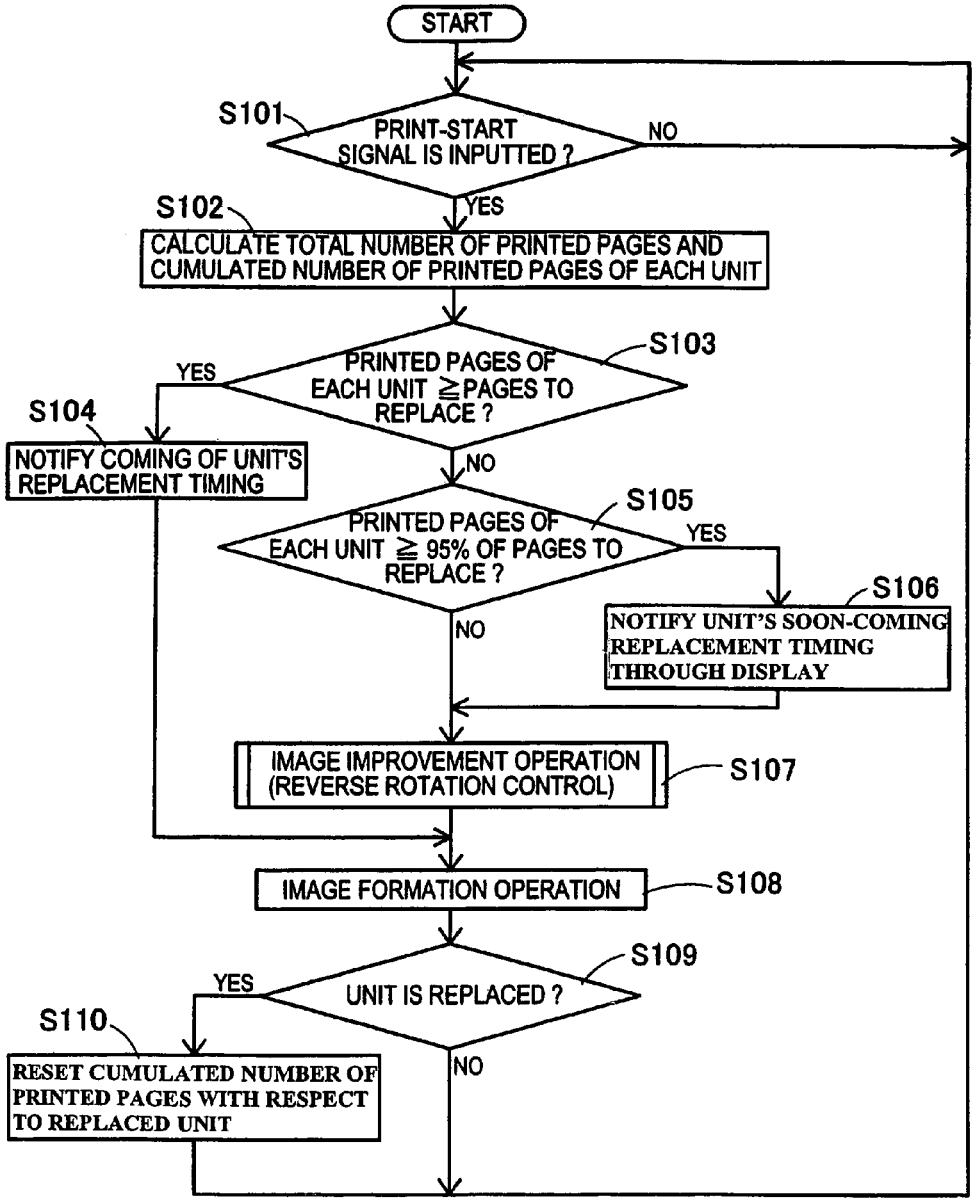
FIG. 6 is a flowchart showing print control of a color printer.
Figure 7:
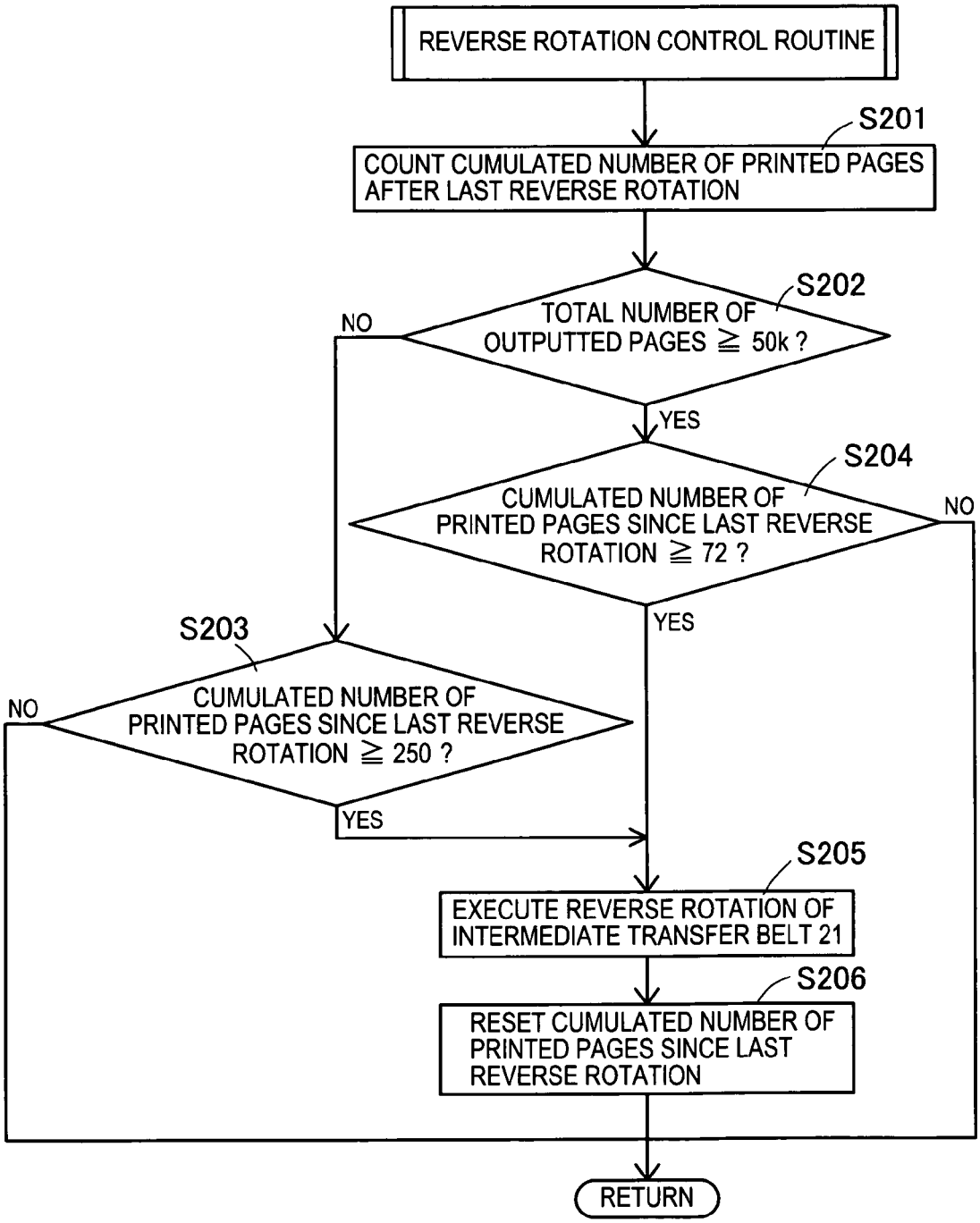
FIG. 7 is a flowchart showing reverse rotation processing of an intermediate transfer belt.

Next, operation of the color printer 1 will be described by referring to FIG. 6 and FIG. 7. Firstly, main routine will be described basing on a flowchart of FIG. 6. When power is turned on and operation starts, the color printer 1 stands by until a print-start signal is inputted (S101). When a print-start signal is inputted (S101: Yes), total number of printed pages since use of the color printer 1 is started and cumulated number of printed pages for each unit are calculated (S102).

In case cumulated number of printed pages for each unit corresponds to its replacement timing (S103; Yes), a name of the unit and replacement timing notice are indicated in the operation panel 75 so as to recommend a user to replace the present unit (S104). In case it is not actual replacement timing but the replacement timing will come soon (S105: Yes), a name of the unit and coming-soon replacement timing notice are indicated in the operation panel 75 (S106). In this embodiment, indication of the coming-soon notice is started from a point that exceeds 95% of total pages directed to replacement timing.

Next, image improvement operation (here, reverse rotation control) is conducted (S107). Details of the operation will be described later. In case it is judged that any one of units reaches its replacement timing through the previous total page calculation (S103: Yes), image improvement operation is not conducted. It goes on to image formation operation (S108). Furthermore, in case any one of the units is replaced with a new one (S109: Yes), number of cumulated printed pages for the replaced unit is reset (S110). After that, the color printer 1 stands by until next input of a print start signal.

Next, reverse rotation control routine will be described by referring to FIG. 7. This routine is executed in S107 in FIG. 6. When this routine starts, cumulated number of printed pages after last reverse rotation is counted (S201). Further on, it is judged whether or not total number of outputted pages since a belt unit 20 was replaced with a new one comes to fifty thousand or more (S202). In case it is over fifty thousand pages (S202: Yes), it is judged whether or not seventy-two or more of pages have been printed since last reverse rotation (S204). In case total number of outputted pages is fewer than fifty thousand (S202: No), it is judged whether or not two hundred and fifty or more of pages have been outputted since last reverse rotation (S203).

In case the total number of printed pages is fewer than fifty thousand and cumulated number of printed pages since last reverse rotation is fewer than two hundred and fifty (S202: No and S203: No) or in case total number of pages is fifty thousand or more and cumulated number of pages since last reverse rotation is fewer than seventy two pages (S202: Yes and S204: No), this routine straight terminates. In case the total number of printed pages is fewer than fifty thousand and cumulated number of printed pages since last reverse rotation is two hundred and fifty or more (S202: No and S203: Yes), or in case total number of pages is fifty thousand or more and cumulated number of pages since last reverse rotation is seventy-two or more (S202: Yes and S204: Yes), reverse rotation should be executed. So, reverse rotation of the intermediate transfer belt 21 is executed (S205) and cumulated number of printed pages since the last reverse rotation is reset (S206), whereby this routine terminates.

The present embodiment picks up reverse rotation control as an example of image improvement operation. However, there are various kinds of image improvement operations such as shown in FIG. 5. When any one of units reaches its replacement timing, an operation of them shall be stopped. Furthermore, depending on kinds of image improvement operations, image-quality deterioration speed after stop of an image improvement operation differs. FIG. 5 indicates three levels of image-quality deterioration speed: from the slowest, "deteriorates gradually"; "deteriorates rapidly"; and "deteriorates instantly". Therefore, depending on degree of urgency, order of operation-stop precedence can be determined.

Figure 8:
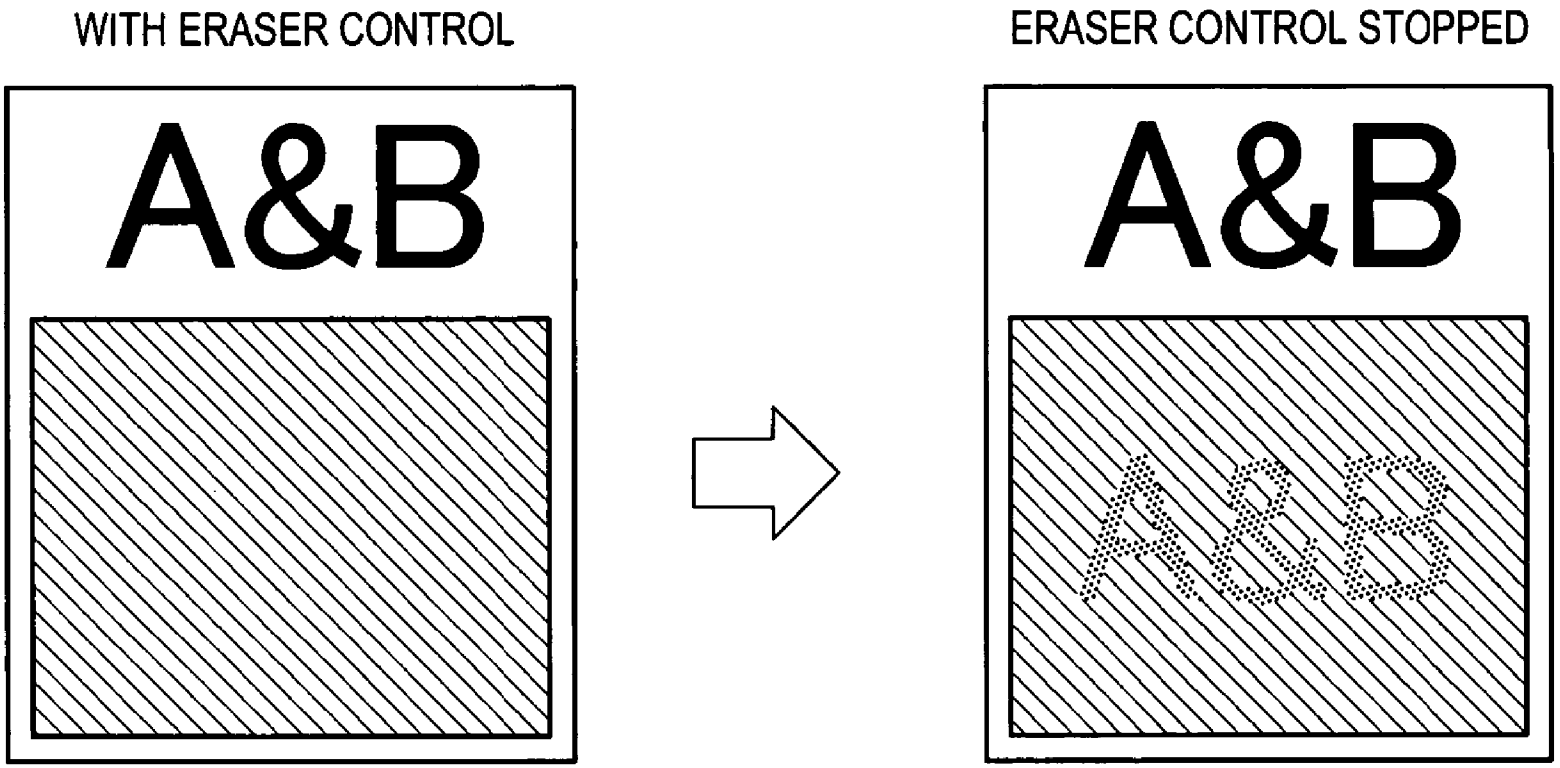
FIG. 8 is a diagram illustrating appearance of a ghost due to stop of erase control.

For example, in case reverse rotation control is stopped, image quality rapidly deteriorates within of about next one hundred pages of printing. Noises due to unwiped portion on a belt unit suddenly appear on printed images at a certain point within the next one hundred pages. On the other hand, image-quality deterioration speed is slow in case of density adjustment for image quality or the like. Furthermore, in case of eraser control for noise elimination, noises appear on an image formed immediately after stop of eraser control. That is, in case charges remain on the photosensitive drum 11 after development, a ghost image is formed on a portion of the photosensitive drum 11 used for next printing, as shown in FIG. 8.

As described, the color printer 1 directed to this embodiment indicates coming-soon replacement timing of a unit in its operation panel 75. Furthermore, in case replacement timing of the unit has come, the color printer 1 indicates the fact in the operation panel 75 and stops one of image quality improvement operations. Accordingly, after reaching the replacement timing, quality of output images deteriorates.

Thereby, the color printer 1 can persuasively notify a user of necessity of unit replacement for sure and strongly urge the user to replace the unit with a new one.

Second Embodiment

A second embodiment will be described in detail by referring to drawings. The only difference between the second embodiment and the first embodiment is processing manner to be taken when each unit reaches its replacement timing.

In this embodiment, when a certain unit reaches its replacement timing, plural image improvement operations are stopped. That is, when any one of the replaceable units reaches its replacement timing, the color printer 1 notifies a user of that fact and makes the intermediate transfer belt 21 rotate in a reverse direction once. Then, the color printer 1 stops reverse rotation control and surface potential adjustment for density adjustment. One round of reverse rotation is made so as to once remove a foreign matter staying on the intermediate transfer belt 21. Thereby, image quality deteriorates gradually and within the next one hundred pages of printing, noises come to appear clearly in outputted images. That is, since image quality does not deteriorate so suddenly, a user does not feel strangeness to image deterioration. Thereby, the color printer 1 can make a user recognize image deterioration naturally and urge the user to replace the unit with a new one.

Furthermore, there is set final replacement timing to replace a unit without delay by all means. That is, in case a unit reaches its final replacement timing, eraser control is stopped. Thereby, image quality deteriorates instantly, and such situation strongly urges a user to replace the unit. In case the user keeps using despite the instant deterioration, the color printer 1 may forcedly stop operation after giving a predetermined warning.

Figure 9:
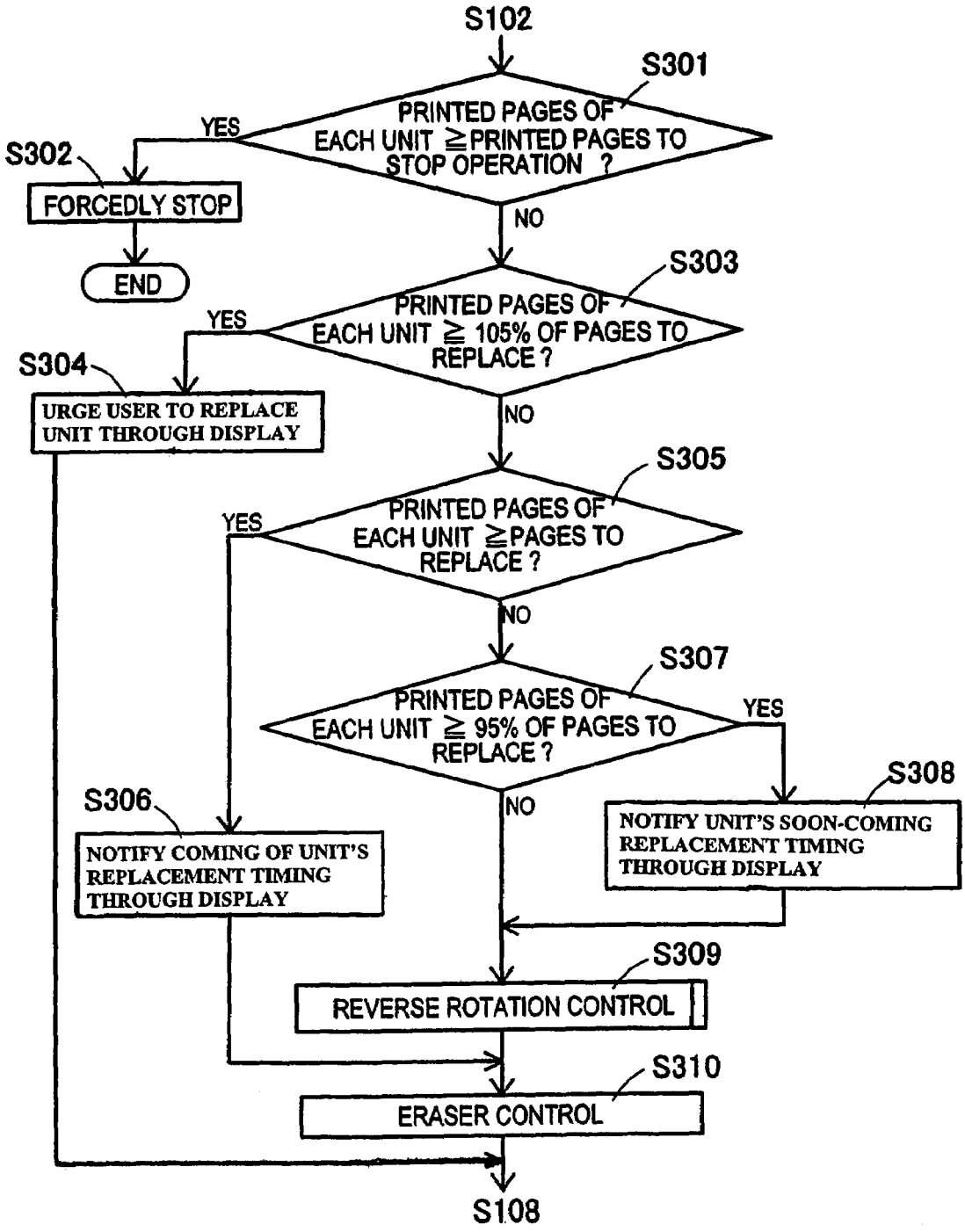
FIG. 9 is a flowchart showing print control of a color printer directed to a second embodiment.

Next, operation of the color printer 1, following the manner of the second embodiment, will be described by referring to a flow chart of FIG. 9. The operation in FIG. 9 corresponds to a partially-modified main routine of FIG. 6 and FIG. 9 shows modified portions only. Steps S102 on the top and S108 on the bottom in FIG. 9 mean to link to S102 and S108 of the main routine in FIG. 6, respectively.

In the main routine, by finishing S102, total number of printed pages and cumulated number for printed pages of each unit have been calculated. In the steps following to S102, it is judged whether or not each unit reaches its predetermined timings in order. In this routine, judgments are made by four steps, namely, number of printed pages to stop operation (S301), 105% of number of printed pages to replace a unit (S303), number of printed pages to replace a unit (S305), and 95% of number of printed pages to replace a unit (S307). "Number of printed pages to stop operation" indicates timing to desperately stop operation or further use will possibly cause serious trouble to the machine. "Number of printed pages to replace a unit" indicates timing to urge a user to replace the unit with a new one. "105% of number of printed pages to replace a unit" indicates timing to strongly urge a user to replace the unit with a new one over proper replacement timing. "95% of number of printed pages to replace a unit" indicates timing to previously notify a user of replacement timing that will come soon. Those four stages of timing are predetermined for each unit.

In S301 of FIG. 9, it is judged whether or not number of printed pages for each unit reaches its operation-stop timing. In case a unit has reached its operation-stop timing, (S301: Yes), further use should be stopped. Accordingly, warning is indicated through display and the color printer 1 is forcedly stopped (S302). The color printer 1 is forcedly stopped and image formation cannot be conducted until the unit is replaced with a new one.

Alternatively, in case number of printed pages does not reach any one of timing (S301: No, S303: No, S305: No, S307: No), reverse rotation control (S309) and eraser control (S310) are conducted in order and then, processing goes on to S108 to conduct image formation operation. The manner of reverse rotation control is same as shown in FIG. 7 directed to the first embodiment. Eraser control is to erase charges remaining on the photosensitive drum 11.

Alternatively, in case number of printed pages reaches 95% of number of printed pages for replacement (S307: Yes), soon-coming replacement timing is notified through display (S308). After that, reverse rotation control (S309) and eraser control (S310) are conducted and then, processing image formation operation is conducted (S108 in FIG. 6).

Alternatively, in case number of printed pages reaches number of printed pages for replacement timing of each unit (S305: Yes), replacement of each unit is urged through display (S306). After S306, only eraser control (S310) is conducted without reverse rotation control and then, image formation operation is conducted (S108 in FIG. 6). As a result, image quality deteriorates gradually.

Alternatively, in case number of printed pages exceeds 105% of number of printed pages for replacement (S303: Yes), replacement of each unit is strongly urged through display (S304). Further on, image formation operation is conducted (S108) without conducting reverse rotation control and eraser control. Since eraser control is stopped, noises appear on the very next printed page. Image quality thus instantly deteriorates, which can strongly recommend a user to replace the unit. That is, items for improvement control of which image quality deterioration speed are slower are stopped earlier whereas items of which image quality deterioration speed are faster are stopped later. Finally, image formation operation is forcedly stopped (S302).

As described, the color printer 1 directed to this embodiment urges a user to replace a unit with a new one through its display after the unit reaches its replacement timing. Thereby, image quality deteriorates gradually. In case the user keeps using without replacing the unit, image quality deteriorates even worse. Thereby, image quality deterioration can make the user realize necessity to replace the unit and strongly urge replacement.

The above described embodiments are provided for merely illustrative purpose, and the present invention is not limited thereto. Of course, various modifications or variations can occur without departing the spirit of the invention.

For example, image improvement operations for urging unit replacement are not limited to the above described. Whatever manners may be acceptable as long as the manners can make quality of outputted image different from an image before improvement operation. Above all, a manner to choose and stop control operation readily feasible without giving damages to the machine is preferable.

Numbers of printed pages at replacement timing in each embodiment are indicated as an example, i.e., it is not restricted to the number specified in each embodiment.

In each embodiment, a toner-packaged-type print unit is employed, however, a toner-replenish-type print unit is applicable similarly.

As long as replaceable parts are included, things to be replaced are not necessarily designed in a form of unit type.

Even if a unit reaches its replacement timing, processing can go to step to notify replacement timing without stopping image formation operation forcedly, in case excessive use of the unit causes image quality deterioration but does not affect the main part of the machine and other operations.

Application of the present invention is not restricted to a printer but it is applicable to a copier, a facsimile and the like as long as it is an image forming apparatus provided with replaceable units. An image forming apparatus does not make any difference whether it is color or monochrome, and digital or analog.

As apparent from the above description, according to the present invention, there is provided an image forming apparatus that surely notifies a user of unit replacement timing and strongly urges the user to replace units without additional apparatus being applied thereto.

What is claimed is:

1. An image forming apparatus comprising at least one replaceable image forming unit and improvement controlling unit that controls to improve image quality of an image to be formed, the image forming apparatus conducting improvement control with the improvement controlling unit and forming an image on a recording medium with the image forming unit, wherein the image forming apparatus further comprises:

a remaining life detecting unit that detects remaining life left for the image forming unit; and an improvement prohibiting unit that prohibits improvement control by the improvement controlling unit when a remaining life of the image forming unit decreases to improvement prohibiting level or less.

2. An image forming apparatus according to claim 1 further comprising:

a display section that displays a message for a user; and a replace-urging-message displaying unit that displays a message that urges a user to replace an image forming unit with a new one in the display section when remaining life of the image forming unit detected by the remaining life detecting unit is predetermined precautionary level or less.

3. An image forming apparatus according to claim 2, wherein precautionary level of the replace-urging-message displaying unit is higher than improvement prohibiting level of the improvement prohibiting unit in terms of length of remaining life.

4. An image forming apparatus according to claim 3, wherein:

plural items for improvement control to be done by the improvement controlling unit are provided;

a first improvement prohibiting level that is higher and a second improvement prohibiting level that is lower in terms of remaining life are provided as improvement prohibiting levels for the improvement prohibiting unit;

the improvement prohibiting unit prohibits at least one item for improvement control in case remaining life detected by the remaining life detecting unit decreases to the first improvement prohibiting level or lower; and the improvement prohibiting unit prohibits at least one remaining item for improvement control in case remaining life detected by the remaining life detecting unit decreases to the second improvement prohibiting level or lower.

5. An image forming apparatus according to claim 2 further comprising a replacement-demanding-message displaying unit that makes the display section to indicate a message that urges a user to replace the image forming unit more strongly than the replace-urging-message displaying unit, when remaining life detected by the remaining life detecting unit decreases below alarm level that is lower than precautionary level.

6. An image forming apparatus according to claim 2, wherein:

plural items for improvement control to be done by the improvement controlling unit are provided;

a first improvement prohibiting level that is higher and a second improvement prohibiting level that is lower in terms of remaining life are provided as improvement prohibiting levels for the improvement prohibiting unit;

the improvement prohibiting unit prohibits at least one item for improvement control in case of remaining life detected by the remaining life detecting unit decreases to the first improvement prohibiting level or lower; and the improvement prohibiting unit prohibits at least one remaining item for improvement control in case remaining life detected by the remaining life detecting unit decreases to the second improvement prohibiting level or lower.

7. An image forming apparatus according to claim 1, wherein:

plural items for improvement control to be done by the improvement controlling unit are provided;

a first improvement prohibiting level that is higher and a second improvement prohibiting level that is lower in terms of remaining life are provided as improvement prohibiting levels for the improvement prohibiting unit;

the improvement prohibiting unit prohibits at least one item for improvement control in case remaining life detected by the remaining life detecting unit decreases to the first improvement prohibiting level or lower; and the improvement prohibiting unit prohibits at least one remaining item for improvement control in case remaining life detected by the remaining life detecting unit decreases to the second improvement prohibiting level or lower.

8. An image forming apparatus according to claim 7, wherein:

the improvement prohibiting unit prohibits an item for improvement control of which image-quality deterioration speed is slower in case remaining life detected by the remaining life detecting unit decreases to the first improvement prohibiting level or lower; and the improvement prohibiting unit prohibits an item for improvement control of which image-quality deterioration speed is faster in case remaining life detected by the remaining life detecting unit decreases to the second improvement prohibiting level or lower.

9. An image forming apparatus according to claim 8 further comprising a forcedly-stop unit that forcedly stops image formation in case remaining life detected by the remaining life detecting unit decreases to predetermined forcedly-stop level or lower, wherein the second improvement prohibiting level of the improvement prohibiting unit is higher than the forcedly-stop level of the forcedly-stop unit in terms of length of remaining life.

10. An image forming apparatus according to claim 7 further comprising a forcedly-stop unit that forcedly stops image formation in case remaining life detected by the remaining life detecting unit decreases to predetermined forcedly-stop level or lower, wherein the second improvement prohibiting level of the improvement prohibiting unit is higher than the forcedly-stop level of the forcedly-stop unit in terms of length of remaining life.

11. An image forming apparatus comprising at least one replaceable image forming unit and improvement controlling unit that controls to improve image quality of an image to be formed, the image forming apparatus conducting improvement control with the improvement controlling unit and forming an image on a recording medium with the image forming unit, wherein the image forming apparatus further comprises:

an improvement prohibiting unit that prohibits improvement control by the improvement controlling unit after predetermined timing;

a display section that displays a message for a user; and a replace-urging-message displaying unit that displays a message that urges a user to replace an image forming unit with a new one in the display section before the improvement prohibiting unit prohibits improvement control.

12. An image forming appartus according to claim 11 further comprising a replacement-demanding-message displaying unit that makes the display section to indicate a message that urges a user to replace the image forming unit more strongly than the replace-urging-message displaying unit after the replacement-urging-message displaying unit displays a message to replace.

13. An image forming apparatus comprising at least one replaceable image forming unit and improvement controlling unit that controls to improve image quality of an image to be formed, the image forming apparatus conducting improvement control with the improvement controlling unit and forming an image on a recording medium with the image forming unit, wherein, plural items for improvement control to be done by the improvement controlling unit are provided; and the image forming apparatus further comprises an improvement prohibiting unit that prohibits the improvement controlling unit from improvement control by different timing depending on items.

14. An image forming apparatus according to claim 13, wherein:

the improvement prohibiting unit prohibits an item of improvement control image-quality of which deterioration speed is slower at earlier timing;

the improvement prohibiting unit prohibits an item of improvement control image-quality of which deterioration speed is higher at later timing.

15. An image forming apparatus according to claim 14 further comprising a forcedly-stop unit that forcedly stops image formation by predetermined timing, wherein the timing that the improvement prohibiting unit prohibits an item for improvement control image-quality of which deterioration speed is higher is earlier than the timing that the forcedly-stop unit forcedly stops image formation.

* * * * *